US009249570B2

(12) United States Patent
Jean

(10) Patent No.: US 9,249,570 B2
(45) Date of Patent: Feb. 2, 2016

(54) CONNECTOR ASSEMBLY FOR MODULAR GROUND COVERING PANELS

(71) Applicant: Everest Plastik Inc., Tracadie-Sheila (CA)

(72) Inventor: Neri Jean, Tracadie-Sheila (CA)

(73) Assignees: 670988 NB INC., Tracadie-Sheila (CA); GSM SOLUTIONS INC., Edmonton (CA)

( * ) Notice: Subject to any disclaimer, the term of this patent is extended or adjusted under 35 U.S.C. 154(b) by 0 days.

(21) Appl. No.: 13/916,834

(22) Filed: Jun. 13, 2013

(65) Prior Publication Data

US 2014/0137505 A1 May 22, 2014

Related U.S. Application Data

(60) Provisional application No. 61/728,308, filed on Nov. 20, 2012.

(51) Int. Cl.
*E04B 5/02* (2006.01)
*E01C 5/00* (2006.01)
(Continued)

(52) U.S. Cl.
CPC ..... *E04B 5/023* (2013.01); *E01C 5/005* (2013.01); *E01C 5/20* (2013.01); *E01C 5/22* (2013.01); *E01C 9/086* (2013.01); *E01C 13/04* (2013.01); *E01C 13/045* (2013.01)

(58) Field of Classification Search
CPC ..... E01C 5/005; E01C 5/00; E01C 13/00; E01C 9/086; E01C 5/20; E01C 5/22; E01C 13/04; E01C 13/045; E04B 5/023
USPC ..... 52/588.1, 584.1
See application file for complete search history.

(56) References Cited

U.S. PATENT DOCUMENTS 4,507,011 A * 3/1985 Brown ..... 403/404
4,629,358 A * 12/1986 Springston et al. ..... 404/35
(Continued)

FOREIGN PATENT DOCUMENTS

CA 1222166 A 5/1987
CA 2174705 C 1/1999
(Continued)

OTHER PUBLICATIONS

All Terrain Road, brochure, accessed Oct. 28, 2010.
(Continued)

*Primary Examiner* — Andrew J Triggs
(74) *Attorney, Agent, or Firm* — Bereskin & Parr LLP/S.E.N.C.R.L., s.r.l.

(57) ABSTRACT

A system for constructing a load bearing surface includes a plurality of modular ground covering panels. Along at least one first side edge of each of the panels, the lower surface projects beyond the upper surface to define a lower peripheral tab. Along at least one second side edge of each of the panels, the upper surface projects beyond the lower surface to define an upper peripheral tab. The lower peripheral tab of one of the panels and the upper peripheral tab of another one of the panels overlappingly engage so that the upper surfaces of the panels are in adjoining relation to form the load bearing surface. A connector assembly includes a first connection element fixed to the lower peripheral tab, and a second connection element that releasably fastens the upper peripheral tab to the first connection element to secure the panels together.

11 Claims, 5 Drawing Sheets

(51) Int. Cl.

| | |
|---|---|
| ***E01C 13/00*** | (2006.01) |
| ***E01C 13/04*** | (2006.01) |
| ***E01C 5/20*** | (2006.01) |
| ***E01C 5/22*** | (2006.01) |
| ***E01C 9/08*** | (2006.01) |

(56) References Cited

U.S. PATENT DOCUMENTS

| | | | | |
|---|---|---|---|---|
| 6,511,257 | B1 * | 1/2003 | Seaux et al. | 404/34 |
| 6,652,183 | B2 | 11/2003 | Stasiewich et al. | |
| 6,685,388 | B2 * | 2/2004 | Webster et al. | 404/35 |
| 6,695,527 | B2 | 2/2004 | Seaux et al. | |
| D524,952 | S | 7/2006 | Ardern | |
| 7,303,800 | B2 * | 12/2007 | Rogers | 428/44 |
| 7,413,374 | B2 | 8/2008 | Rogers et al. | |
| 7,434,364 | B2 * | 10/2008 | MacDermott et al. | 52/584.1 |
| D581,553 | S | 11/2008 | Cooper | |
| 7,779,595 | B2 | 8/2010 | Polk, Jr. | |
| 8,091,314 | B2 | 1/2012 | Polk, Jr. et al. | |
| 8,414,217 | B2 | 4/2013 | Rosan | |
| 2012/0266549 | A1 | 10/2012 | Rosan | |

FOREIGN PATENT DOCUMENTS

| | | | |
|---|---|---|---|
| CA | 2271572 | A1 | 3/1999 |
| CA | 2498575 | A1 | 3/2004 |
| CA | 2469432 | A1 | 5/2004 |
| CA | 2472841 | A1 | 1/2006 |
| CA | 2551042 | A1 | 12/2007 |
| CA | 2463306 | C | 1/2008 |
| CA | 2593600 | C | 10/2009 |
| CA | 2407574 | C | 1/2010 |
| CA | 2668108 | A1 | 12/2010 |
| CA | ID144161 | | 4/2013 |
| CA | ID147188 | | 4/2013 |
| EP | 1845195 | A2 | 10/2007 |
| WO | 2012145490 | A1 | 10/2012 |

OTHER PUBLICATIONS

DuraBase Temporary Roads & Mats, Pro-Tec Equipment, website excerpt, accessed Jun. 25, 2012.

Dura-Base Composite Mat System, Newpark Resources, Inc., website excerpt, accessed Oct. 28, 2010.

Newpark Mats & Integrated Services, Newpark Resources, Inc., website excerpt, accessed Jun. 25, 2012.

Extended European Search Report issued Nov. 16, 2015 in respect of European Patent Application No. 13171773.8.

* cited by examiner

CONNECTOR ASSEMBLY FOR MODULAR GROUND COVERING PANELS

CROSS-REFERENCE TO RELATED APPLICATION

This application claims priority to U.S. Patent Application No. 61/728,308 filed on Nov. 20, 2012, the entire contents of which are hereby incorporated herein by reference.

FIELD

The present disclosure relates generally to modular ground covering panels that are constructed to form a load bearing surface.

BACKGROUND

U.S. Pat. No. 6,511,257 describes a reusable mat system for the construction of load bearing surfaces, such as temporary roadways and equipment support surfaces, over unstable or unsubstantial terrain, comprising durable, interlocking individual mats which can be quickly and easily installed in a single application, and which can thereafter be easily removed and stored until needed again. The individual mats interlock on all sides to form stable and continuous load bearing surfaces, and exhibit favorable traction characteristics.

U.S. Pat. No. 6,652,183 describes a road mat that includes a body having a first end, a second end, a first face and a second face. A first coupling is positioned at the first end has an outwardly extending portion extending outwardly from the first end adjacent to the second face, an angled portion extending from a remote end of the outwardly extending portion toward but not past the first face, and an inwardly extending retaining lip extending from a remote end of the angled portion back toward the first end. A second coupling is positioned at the second end is similarly configured with an outwardly extending portion extending outwardly from the second end adjacent to the first face, an angled portion and an inwardly extending retaining lip. The retaining lip of the second coupling engages the retaining lip of the first coupling preventing separation.

U.S. Pat. No. 7,413,374 describes a portable overlapping secured mat system with uniformly sized plastic mats joined together to form structural support surface for use by persons or equipment. The mats' edges have recessed upper and lower lips with finger projections extending from the upper lips sized to fit into holes of adjacent mats' lower lips securing the mats together when the front edge of the finger projections are moved into a recesses of the back wall of the hole.

INTRODUCTION

The following is intended to introduce the reader to the more detailed description that follows and not to define or limit the claimed subject matter.

According to an aspect of the present disclosure, a system for constructing a load bearing surface may include: at least first and second modular ground covering panels, each of the panels including upper and lower surfaces, wherein along at least one first side edge of each of the panels the lower surface projects beyond the upper surface to define a lower peripheral tab, wherein along at least one second side edge of each of the panels the upper surface projects beyond the lower surface to define an upper peripheral tab, and wherein the lower peripheral tab of one of the panels and the upper peripheral tab of another one of the panels are adapted to overlappingly engage so that the upper surfaces of the panels are in adjoining relation to form the load bearing surface; and at least one connector assembly including a first connection element fixed to the lower peripheral tab, and a second connection element that releasably fastens the upper peripheral tab to the first connection element to secure the panels together.

The second connection element may be fastened to and unfastened from the first connection element generally from above the upper surfaces of the panels. The upper peripheral tab may include at least one aperture, and the second connection element may include a bolt that extends through the aperture. A head of the bolt may be accessible from above the upper surfaces of the panels. The first connection element may include a nut configured to receive the bolt, and the nut may be retained in position relative to the lower peripheral tab so that rotation of the nut about a bolt axis is not permitted. The lower peripheral tab may include a first flange surface, and the upper peripheral tab may include a second flange surface, and tightening the bolt relative to the nut may cause the flange surfaces to bear against one another in opposed relation. The flange surfaces may be generally parallel to a plane defined by the upper surfaces of the panels.

The connector assembly may include at least one brace plate for distributing forces to at least one of the peripheral tabs. The second connection element may include a first brace plate arranged between the head of the nut and the upper peripheral tab. The upper peripheral tab may include a recess generally surrounding the aperture, and the first brace plate may be received within the recess. The first connection element may include a second brace plate that is mounted to the lower peripheral tab. The lower peripheral tab may include a recess generally surrounding the first connection element, and the second brace plate may be received within the recess. The first connection element may include a third brace plate that is mounted to the first flange surface. The first flange surface may include a recess generally surrounding the first connection element, and the third brace plate may be received within the recess. Tightening the bolt relative to the nut may draw the second and third base plates towards the first base plate, thereby securing the peripheral tabs together.

The first connection element may include a body housing the nut in secure arrangement. An interior of the body may be complementary in shape to an exterior of the nut. The nut may be removable from the body. The first connection element may include a clip adapted to retain the nut in the body. A plurality of the connector assemblies may be spaced apart along the adjoined side edges of the panels.

According to an aspect of the present disclosure: a first panel includes upper and lower surfaces and side edges, and along at least one first side edge the lower surface projects beyond the upper surface to define a lower peripheral tab; a second panel includes upper and lower surfaces and side edges, along at least one second side edge the upper surface projects beyond the lower surface to define an upper peripheral tab, the upper peripheral tab including an aperture, and the upper peripheral tab is adapted to overlappingly engage the lower peripheral tab of the first panel so that the upper surfaces of the first and second panels are in adjoining relation to form a load bearing surface; and a connector assembly including a nut retained in position relative to the lower peripheral tab so that rotation of the nut about a bolt axis is not permitted, and a bolt that extends through the aperture of the upper peripheral tab, the nut being adapted to receive the bolt to releasably fasten the upper peripheral tab of the second panel to the lower peripheral tab of the first panel to secure the panels together.

According to an aspect of the present disclosure: a first panel includes upper and lower surfaces and side edges, and along at least one first side edge the lower surface projects beyond the upper surface to define a lower peripheral tab; a second panel includes upper and lower surfaces and side edges, along at least one second side edge the upper surface projects beyond the lower surface to define an upper peripheral tab, the upper peripheral tab adapted to overlappingly engage the lower peripheral tab of the first panel so that the upper surfaces of the first and second panels are in adjoining relation to form a load bearing surface, and the upper peripheral tab includes an aperture; and a connector assembly including a first connection element fixed to the lower peripheral tab, and a second connection element that releasably fastens the upper peripheral tab to the first connection element to secure the panels together, the connector assembly including at least one brace plate for distributing forces to at least one of the peripheral tabs.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods are described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

In general, the concepts described herein pertain to a load bearing surface formed by a plurality of modular ground covering panels having upper surfaces arranged in adjoining relation. Each of the panels may include at least one peripheral tab that overlapping engages a peripheral tab of at least one adjacent panel. A plurality of connector assemblies secures the panels together. Each of the connector assemblies includes a first connection element that is fixed to a peripheral tab of one of the panels, and a second connection element that releasably fastens the corresponding peripheral tab of the adjacent panel to the first connection element.

Figure 1:
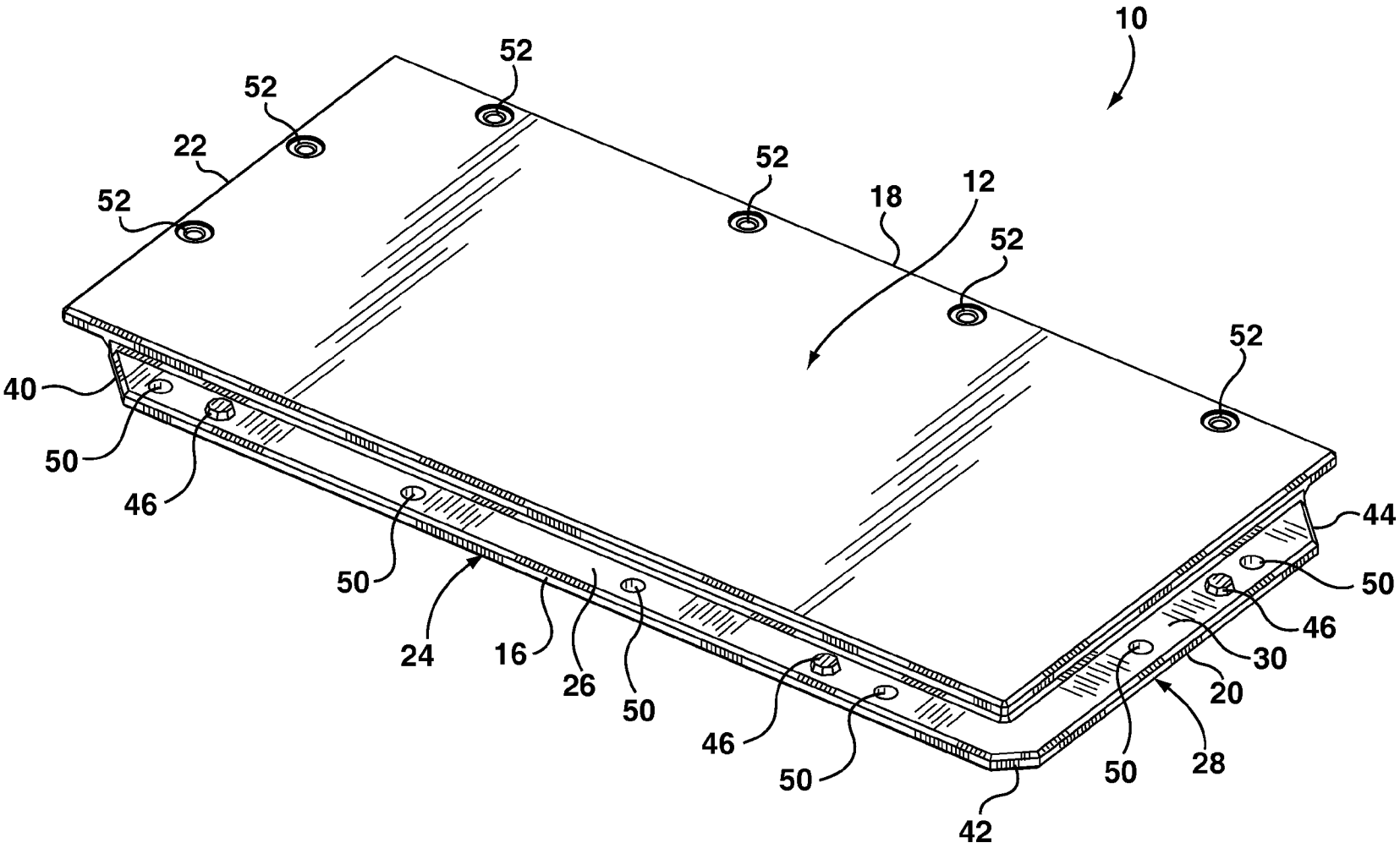
FIGS. 1 and 2 are upper and lower perspective views, respectively, of an example of a modular ground covering panel.
Figure 2:
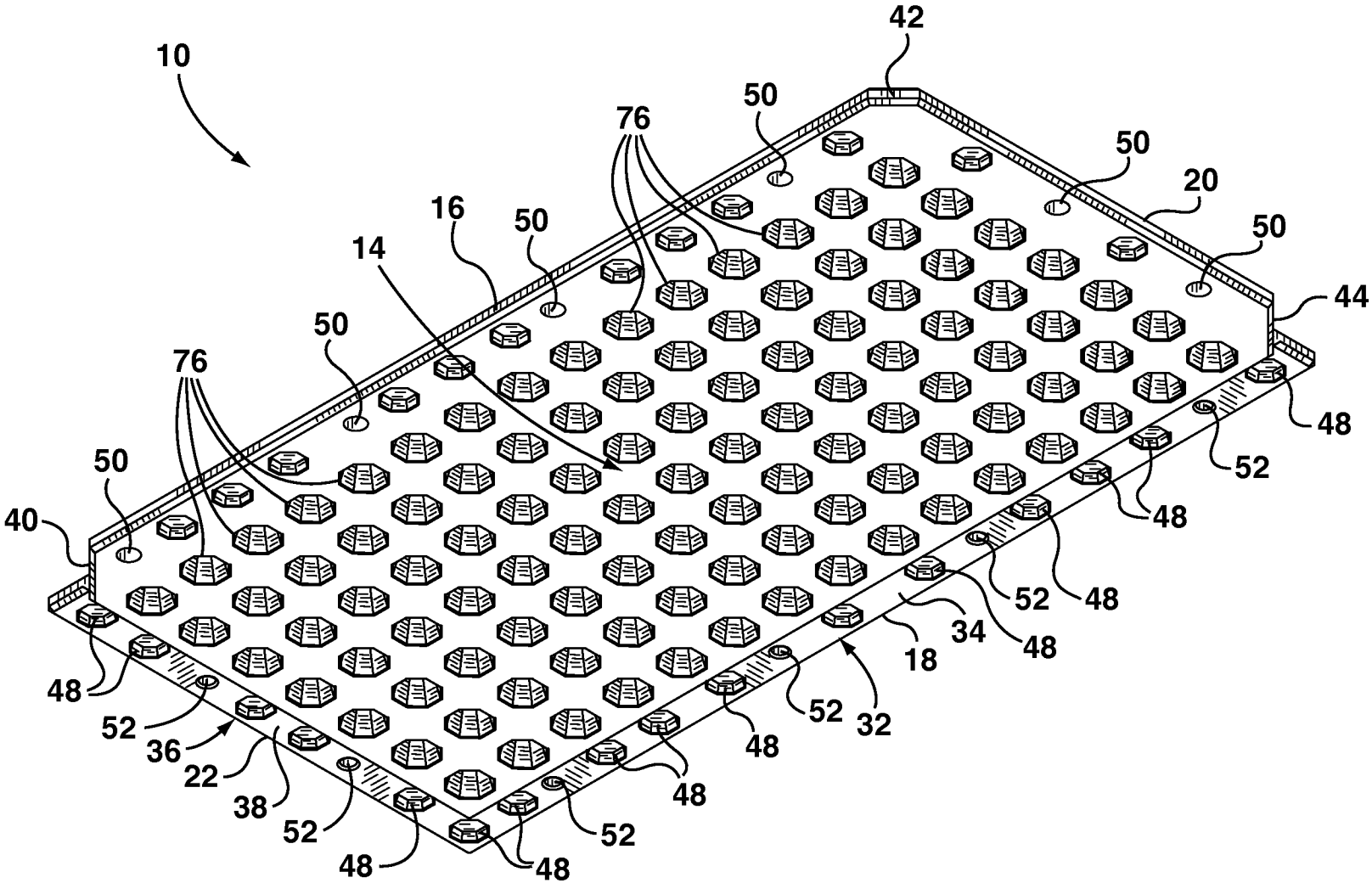

Referring to FIGS. 1 and 2, an example of a modular ground covering panel is shown generally at reference numeral 10. The panel 10 includes an upper surface 12, and a lower surface 14 arranged spaced apart from the upper surface 12 and generally parallel thereto.

The panel 10 may be formed of plastic material, for example but not limited to, low-density polyethylene (LDPE). The panel 10 may be hollow, and may be manufactured using a rotational molding process. Optionally, the upper surface 12 may include traction features, such as a repeating diamond plate pattern or the like. The panel 10 may be configured according to various sizes and shapes, and the present teachings should not be limited to the particular configuration illustrated in the drawings. In some examples, the panel 10 may be produced to have dimensions of about 85"× 180"×6".

In the example illustrated, the panel 10 includes first, second, third and fourth side edges 16, 18, 20, 22. The first side edge 16 extends between bevel corners 40, 42; the third side edge 20 extends between bevel corners 42, 44. The first and second side edges 16, 18 extend generally in parallel in a longitudinal direction between the third and fourth side edges 20, 22. The third and fourth side edges 20, 22 extend generally in parallel in a lateral direction between the first and second side edges 16, 18.

In the example illustrated, along the first side edge 16, the lower surface 14 projects beyond the upper surface 12 to define a lower peripheral tab 24 (FIG. 1). The lower peripheral tab 24 presents an elongate flange surface 26 generally along a longitudinal extent of the panel 10 between the third and fourth side edges 20, 22. Furthermore, along the third side edge 20, the lower surface 14 projects beyond the upper surface 12 to define a lower peripheral tab 28 (FIG. 1). The lower peripheral tab 28 presents an elongate flange surface 30 generally along a lateral extent of the panel 10 between the first and second side edges 16, 18. The flange surfaces 26, 30 may be generally parallel to a plane defined by the upper surface 12.

Conversely, along the second side edge 18, the upper surface 12 projects beyond the lower surface 14 to define an upper peripheral tab 32 (FIG. 2). The upper peripheral tab 32 presents an elongate flange surface 34 generally along a longitudinal extent of the panel 10 between the third and fourth side edges 20, 22. Moreover, along the fourth side edge 22, the upper surface 12 projects beyond the lower surface 14 to define an upper peripheral tab 36 (FIG. 2). The upper peripheral tab 36 presents an elongate flange surface 38 generally along a lateral extent of the panel 10 between the first and second side edges 16, 18. The flange surfaces 34, 38 may also be generally parallel to a plane defined by the upper surface 12.

Given two of the panels 10 arranged next to one another in a side-by-side relationship, the tabs 24, 32 are sized and shaped for overlapping engagement, with the flange surfaces 26, 34 in opposed relation. Similarly, given two of the panels 10 arranged next to one another in an end-to-end relationship, the tabs 28, 36 are sized and shaped for overlapping engagement, with the flange surfaces 30, 38 in opposed relation. Other arrangements for the panel 10 may be possible.

In the example illustrated, the panel 10 includes a plurality of first connection elements 50 spaced apart along the tabs 24, 28. The panel 10 also includes a plurality of apertures 52 spaced apart along the tabs 32, 36, extending between the upper surface 12 and the flange surfaces 34, 38. The apertures 52 may be positioned in corresponding registration with the first connection elements 50 of an adjacent panel 10, with either the flange surfaces 26, 34 or the flange surfaces 30, 38 being in opposed relation.

Optionally, as illustrated, the panel 10 may include protrusion elements 46 spaced apart along the tabs 24, 28. Complementary recess elements 48 are spaced apart along the tabs 32, 36, and receive the protrusion elements 46 to provide a means for quick positioning of panels 10 to be joined together, prior to being secured. A greater number of the recess elements 48 may be provided so as to allow options for a staggered arrangement of the panels 10.

Figure 3:
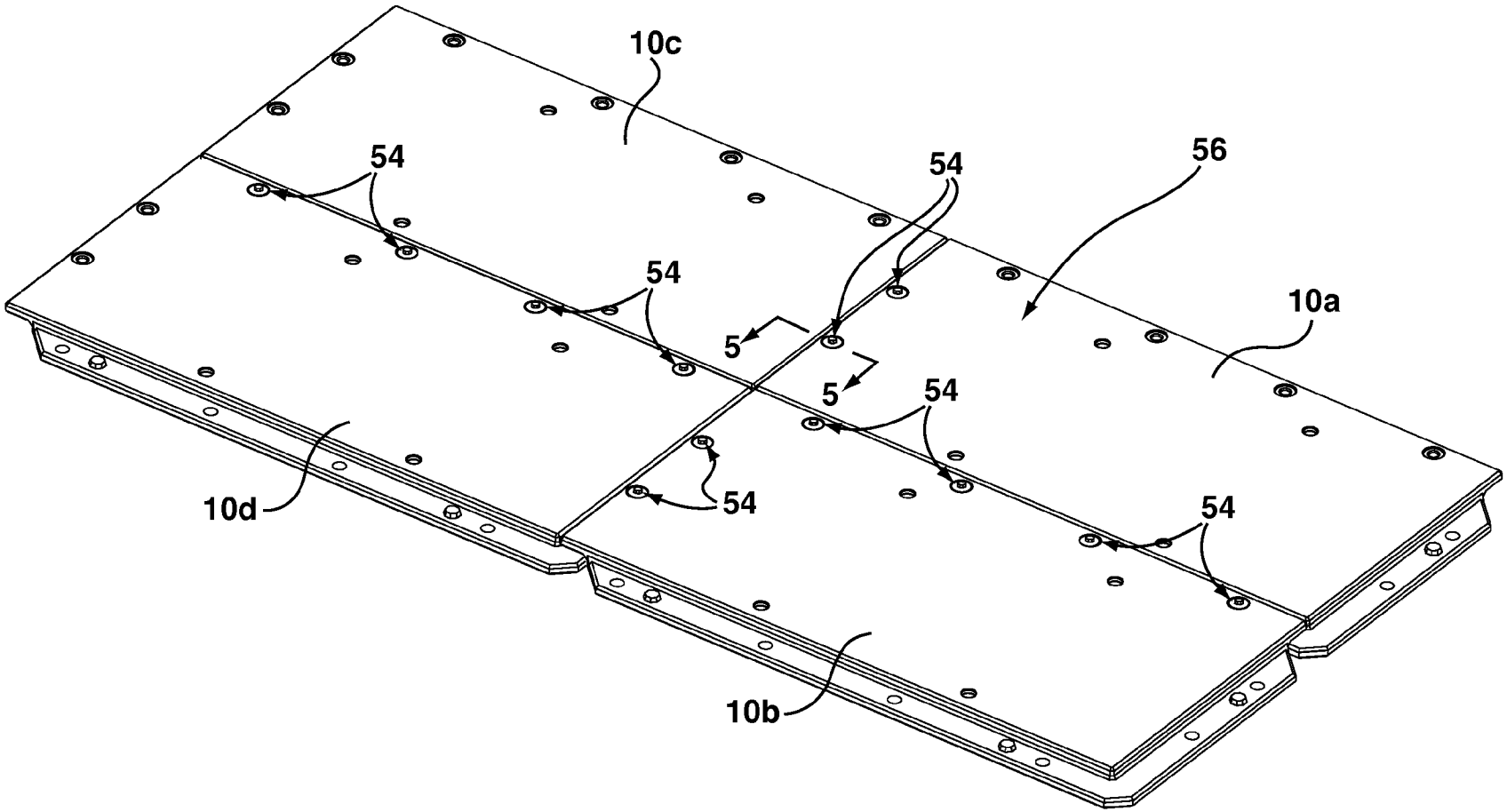
FIG. 3 is an upper perspective view of a plurality of the modular ground covering panel of FIGS. 1 and 2, and constructed to form a load bearing surface.

Referring now to FIG. 3, a system is shown consisting of four of the panels 10, denoted by reference numerals 10*a*, 10*b*, 10*c* and 10*d*. The panel 10*a* is arranged next to the panel 10*b* in a side-by-side relationship, whereas the panel 10*a* is arranged next to the panel 10*c* in an end-to-end relationship, etc. A plurality of connector assemblies 54 secure the panels 10*a*, 10*b*, 10*c*, 10*d* together in adjoining relation, so that the upper surfaces of the 10*a*, 10*b*, 10*c*, 10*d* form a load bearing surface 56. As illustrated, the connector assemblies 54 may be spaced apart along the side edges of the panels 10*a*, 10*b*, 10*c*, 10*d* at regular intervals.

Figure 4:
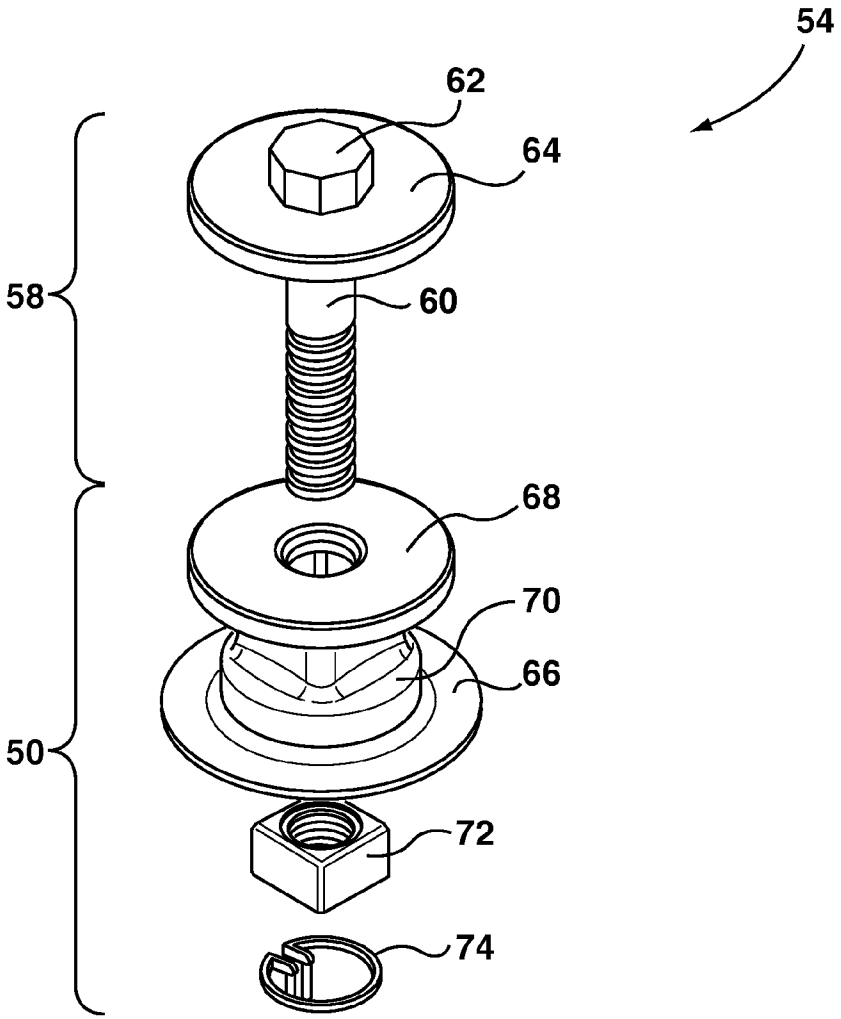
FIG. 4 is an exploded view of an example of a connector assembly for use with the modular ground covering panel of FIGS. 1 and 2.

Referring to FIG. 4, the connector assembly 54 may include the first connection element 50, and a second connection element 58. In the example illustrated, the second connection element 58 includes a bolt 60 having a head 62, and the bolt 60 extends through a brace plate 64. The first connection element 50 includes brace plates 66, 68, a body 70 arranged between the brace plates 66, 68, a nut 72 retained by the body 70, and a clip 74. The bolt 60 and the nut 72 include complementary threads that facilitate the second connection element 58 being releasably fastened to the first connection element 50. The threads of the bolt 60 have an axial dimension 84 parallel to a bolt axis 80, and the threads of the nut 72 have a height dimension 86 parallel to the bolt axis 80. In the example illustrated, the axial dimension 84 is approximately three times larger than the height dimension 86.

Figure 5:
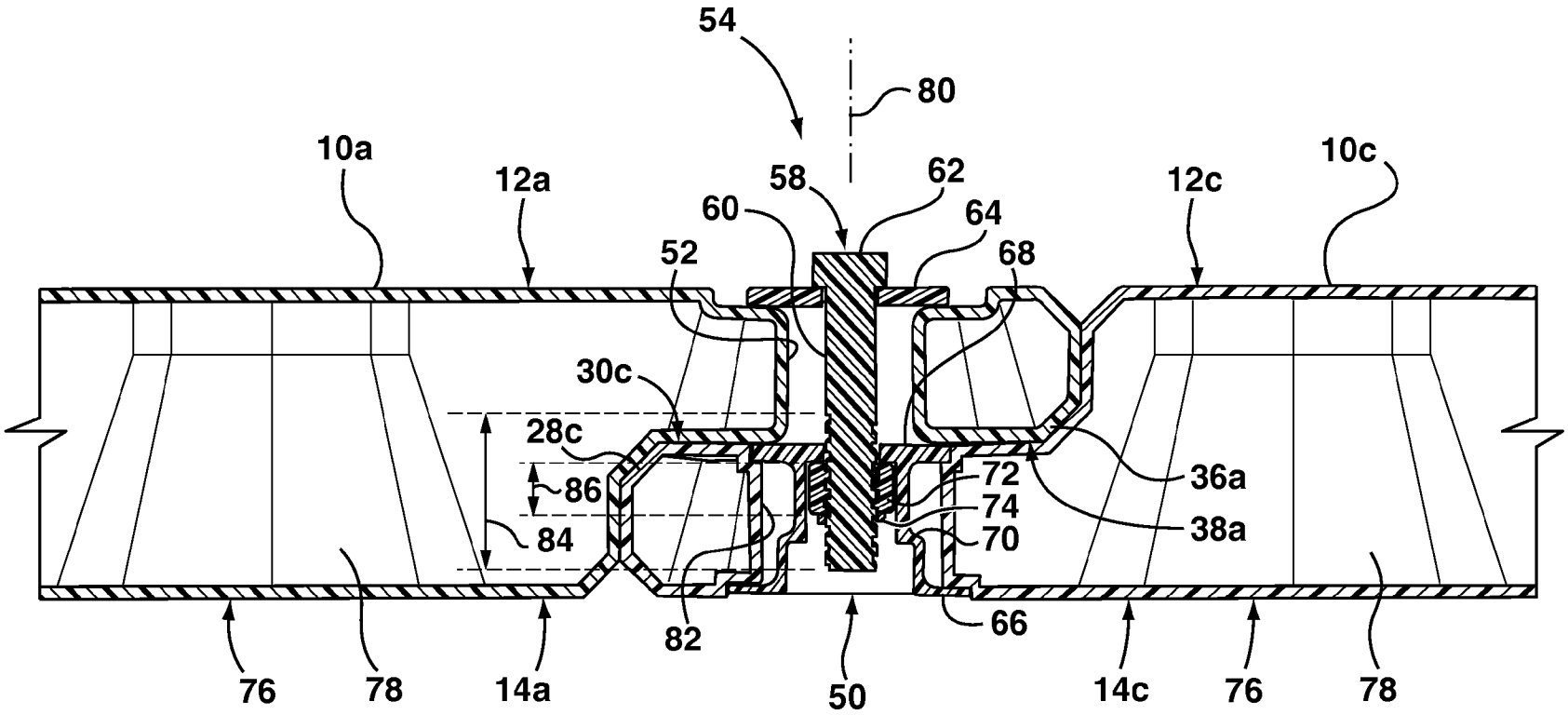
FIG. 5 is a sectional view along line 5-5 in FIG. 4.

Referring now to FIG. 5, the second connection element 58 is shown received in the tab 36*a* in the aperture 52 that extends between the upper surface 12*a* and the flange surface 38*a*. The brace plate 64 is shown mounted to a recess in the upper surface 12*a* of the panel 10*a* so that it is generally flush with the upper surface 12*a*.

The first connection element 50 is shown received in the tab 28*c* in an aperture 82 that extends between the lower surface 14*c* and the flange surface 30*c*. The brace plate 66 is shown mounted to a recess in the lower surface 14*c* of the panel 10*c* so that it is generally flush with the lower surface 14*c*, and the brace plate 68 is shown mounted to a recess in the flange surface 30*c* of the tab 28*c* so that it is generally flush with the flange surface 30*c*. Spacing between the brace plates 66, 68 may be selected so that the tab 28*c* is compressed therebetween. The brace plates 64, 66, 68 distribute forces between the connector assembly 54 and the tabs 36*a*, 28*c*. Accordingly, the first connection element 50 may be rigidly fixed to the tab 28*c*, so that rotation of the first connection element 50 (including the nut 72), e.g., about the bolt axis 80, is generally not permitted.

In the example illustrated, the body 70 houses the nut 72 in secure arrangement, with an interior of the body 70 being complementary in shape to an exterior of the nut 72 (e.g., the nut 72 may have a square profile). The clip 74 may be secured to the interior of the body 70 (e.g., by interference fit) and retains the nut 72 in the body 70. If the nut 72 becomes stripped or otherwise damaged, it may be removed from the body 70 by first releasing the clip 74, and replaced with another one.

In use, tightening the bolt 60 relative to the nut 72 about the bolt axis 80 causes the brace plates 66, 68 to be drawn toward the brace plate 64. Accordingly, the flange surfaces 38*a*, 30*c* bear against one another, securing the panels 10*a*, 10*c* together. The bolt axis 80 may be generally orthogonal to a plane defined by the upper surfaces 12*a*, 12*c*, and the flange surfaces 30*c*, 38*a*, which may promote the flange surfaces 38*a*, 30*c* bearing against one another in a generally uniform manner about the connector assembly 54.

Because the nut 72 is fixed in position, fastening the bolt 60 to the nut 72 is simplified because manipulation of the nut 72 is not required. Also, because the head 62 of the bolt 60 is accessible from above the upper surfaces 12*a*, 12*c*, the second connection element 58 may be installed relatively quickly, through the aperture 52, and fastened to the first connection element 50 while the panels 10*a*, 10*c* lie in adjoining position.

Referring again to FIG. 2, the panel 10 includes a plurality of cavities 76, which as illustrated may be spaced apart across the lower surface 14 in a repeating pattern or array. The cavities 76 depend inwardly from the lower surface 14. In the example illustrated, the cavities 76 are formed by sidewalls 78 (FIG. 5) that extend generally between the upper and lower surfaces 12, 14. The cavities 76 serve to reinforce the panel 10 by forming a generally rigid structure between the upper and lower surfaces 12, 14. Although the cavities 76 are shown to have a hexagonally shaped profile, other geometric shapes and configurations are possible.

While the above description provides examples of one or more apparatuses or methods, it will be appreciated that other apparatuses or methods may be within the scope of the accompanying claims.

I claim:

1. A system for constructing a load bearing surface, comprising:

at least first and second modular ground covering panels, each of the panels comprising upper and lower surfaces, wherein along at least one first side edge of each of the panels the lower surface projects beyond the upper surface to define a lower peripheral tab, wherein along at least one second side edge of each of the panels the upper surface projects beyond the lower surface to define an upper peripheral tab, and wherein the lower peripheral tab of one of the panels and the upper peripheral tab of another one of the panels are adapted to overlappingly engage so that the upper surfaces of the panels are in adjoining relation to form the load bearing surface; and at least one connector assembly comprising a first connection element fixed to the lower peripheral tab, and a second connection element that releasably fastens the upper peripheral tab to the first connection element to secure the panels together, wherein the second connection element is fastened to and unfastened from the first connection element generally from above the upper surfaces of the panels, wherein the upper peripheral tab comprises at least one aperture, and the second connection element comprises a bolt that extends through the aperture, wherein a head of the bolt is accessible from above the upper surfaces of the panels, wherein the first connection element comprises a nut configured to receive the bolt, and the nut is retained in position relative to the lower peripheral tab so that rotation of the nut about a bolt axis is not permitted, wherein the bolt and the nut comprise complementary threads that facilitate the second connection element being releasably fastened to the first connection element, wherein the threads of the bolt have an axial dimension that is at least two times larger than a height dimension of the threads of the nut, wherein the lower peripheral tab comprises a first flange surface, and the upper peripheral tab comprises a second flange surface, and tightening the bolt relative to the nut causes the flange surfaces to bear against one another in opposed relation, wherein the flange surfaces are generally parallel to a plane defined by the upper surfaces of the panels, wherein the connector assembly comprises at least one brace plate for distributing forces to at least one of the peripheral tabs, wherein the second connection element comprises a first brace plate arranged between the head of the bolt and the upper peripheral tab, wherein the first connection element comprises a second brace plate that is mounted to the lower peripheral tab, and a third brace plate that is mounted to the first flange surface, and tightening the bolt relative to the nut draws the second and third brace plates towards the first brace plate, thereby securing the peripheral tabs together, and wherein the first connection element comprises a body arranged between and integrally connecting the second and third brace plates, the body housing the nut in secure arrangement.

2. The system of claim 1 , wherein the first connection element comprises a clip adapted to retain the nut in the body.

3. The system of claim 1 , comprising a plurality of the connector assemblies spaced apart along the adjoined side edges of the panels.

4. A load bearing surface constructed using the system of claim 1.

5. The system of claim 1, wherein an interior of the body is complementary in shape to an exterior of the nut, and the nut is removable from the body.

6. In combination:

a first panel comprising upper and lower surfaces and side edges, and along at least one first side edge the lower surface projects beyond the upper surface to define a lower peripheral tab, the lower peripheral tab comprising a first flange surface, the first flange surface being generally parallel to a plane defined by the upper surface of the first panel;

a second panel comprising upper and lower surfaces and side edges, along at least one second side edge the upper surface projects beyond the lower surface to define an upper peripheral tab, the upper peripheral tab comprising an aperture and a second flange surface, the second flange surface being generally parallel to a plane defined by the upper surface of the second panel, and the upper peripheral tab is adapted to overlappingly engage the lower peripheral tab of the first panel so that the upper surfaces of the first and second panels are in adjoining relation to form a load bearing surface; and a connector assembly comprising a nut retained in position relative to the lower peripheral tab so that rotation of the nut about a bolt axis is not permitted, and a bolt that extends through the aperture of the upper peripheral tab, the nut and the bolt comprising complementary threads that facilitate releasably fastening the upper peripheral tab of the second panel to the lower peripheral tab of the first panel to secure the panels together, the threads of the bolt having an axial dimension that is at least two times larger than a height dimension of the threads of the nut, and tightening the bolt relative to the nut causes the first and second flange surfaces to bear against one another in opposed relation, wherein the connector assembly comprises first and second brace plates mounted to opposing sides of the lower peripheral tab, and a body arranged between and integrally connecting the first and second brace plates, the body housing the nut in secure arrangement.

7. The combination of claim 6, wherein an interior of the body is complementary in shape to an exterior of the nut, and the nut is removable from the body.

8. The combination of claim 7, further comprising a clip adapted to retain the nut in the body.

9. In combination:

a first panel comprising upper and lower surfaces and side edges, and along at least one first side edge the lower surface projects beyond the upper surface to define a lower peripheral tab;

a second panel comprising upper and lower surfaces and side edges, along at least one second side edge the upper surface projects beyond the lower surface to define an upper peripheral tab, the upper peripheral tab adapted to overlappingly engage the lower peripheral tab of the first panel so that the upper surfaces of the first and second panels are in adjoining relation to form a load bearing surface, and the upper peripheral tab comprises an aperture; and a connector assembly comprising a first connection element fixed to the lower peripheral tab, and a second connection element that releasably fastens the upper peripheral tab to the first connection element to secure the panels together, wherein the first connection element comprises a nut that is housed in the lower peripheral tab, wherein the second connection element comprises a bolt that extends through the aperture, wherein the bolt and the nut comprise complementary threads that facilitate the second connection element being releasably fastened to the first connection element, wherein the threads of the bolt have an axial dimension that is at least two times larger than a height dimension of the threads of the nut, and wherein the first connection element comprises first and second brace plates mounted to opposing sides of the lower peripheral tab, and a body arranged between and integrally connecting the first and second brace plates, and the nut is retained by the body.

10. The combination of claim 9, wherein an interior of the body is complementary in shape to an exterior of the nut, and the nut is removable from the body.

11. The combination of claim 10, wherein the first connection element comprises a clip adapted to retain the nut in the body.

* * * * *